US010744066B2

(12) United States Patent
Pittet et al.

(10) Patent No.: US 10,744,066 B2
(45) Date of Patent: Aug. 18, 2020

(54) OVERCAP INTENDED FOR A PHARMACEUTICAL CONTAINER

(71) Applicant: B. Braun Melsungen AG, Melsungen (DE)

(72) Inventors: Michel Pittet, Aumont (CH); Raphael Vallotton, Vevey (CH); Volker Lamprecht, Malsfeld (DE)

(73) Assignee: B. Braun Melsungen AG, Melsungen (DE)

( * ) Notice: Subject to any disclaimer, the term of this patent is extended or adjusted under 35 U.S.C. 154(b) by 395 days.

(21) Appl. No.: 14/761,028

(22) PCT Filed: Jan. 22, 2014

(86) PCT No.: PCT/EP2014/051270

§ 371 (c)(1),
(2) Date: Jul. 15, 2015

(87) PCT Pub. No.: WO2014/114685

PCT Pub. Date: Jul. 31, 2014

(65) Prior Publication Data

US 2015/0352012 A1 Dec. 10, 2015

(30) Foreign Application Priority Data

Jan. 28, 2013 (EP) ..... 13152820

(51) Int. Cl.
*A61J 1/14* (2006.01)
*B65D 51/00* (2006.01)

(52) U.S. Cl.
CPC ..... *A61J 1/1406* (2013.01); *A61J 1/1412* (2013.01); *A61J 1/1431* (2015.05); *B65D 51/002* (2013.01)

(58) Field of Classification Search
CPC ..... A61J 1/1406; A61J 1/1431; A61J 1/1412; B65D 51/002
See application file for complete search history.

(56) References Cited

U.S. PATENT DOCUMENTS 4,997,430 A * 3/1991 Van der Heiden ... A61J 1/2089 604/126
5,632,396 A * 5/1997 Burns ..... B01L 3/50825 215/247

(Continued)

FOREIGN PATENT DOCUMENTS

CN 1530086 A 9/2004
CN 2693225 Y 4/2005

(Continued)

OTHER PUBLICATIONS

International Search Report for Application No. PCT/EP2014/051270 dated Apr. 17, 2014.

*Primary Examiner* — Ariana Zimbouski
(74) *Attorney, Agent, or Firm* — Clements Bernard Walker; Seth L. Hudson

(57) ABSTRACT

The present invention relates to an overcap intended for a pharmaceutical container, in particular a container for an infusion solution or an injection solution, having a receptacle containing at least one preproduced closure stopper accommodated therein, the stopper consisting of a soft plastic material, optionally after pulling off a protective covering, for insertion of a withdrawal cannula, a spike and/or a transfer set.

13 Claims, 2 Drawing Sheets

(56) References Cited

U.S. PATENT DOCUMENTS

| | | | | |
|---|---|---|---|---|
| 8,382,709 | B2 * | 2/2013 | Flanagan | A61M 25/1034 604/103.06 |
| 8,720,715 | B2 * | 5/2014 | Mader | A61J 1/1406 215/247 |
| 2007/0007229 | A1 * | 1/2007 | Yousif | B29C 65/76 215/232 |
| 2007/0080129 | A1 * | 4/2007 | Becker | B29C 45/16 215/247 |

FOREIGN PATENT DOCUMENTS

| | | | | |
|---|---|---|---|---|
| CN | 200951194 | Y | | 9/2007 |
| CN | 201002788 | Y | | 1/2008 |
| CN | 102366348 | A | | 3/2012 |
| DE | 3543825 | A1 | | 6/1986 |
| DE | 10 2004 034 899 | A1 | | 5/2005 |
| DE | 20 2005 013 728 | U1 | | 11/2005 |
| EP | 0093056 | B1 | | 11/1986 |
| EP | 0 297 854 | A2 | | 6/1988 |
| EP | 0 297 854 | A2 | | 1/1989 |
| EP | 0297854 | | * | 4/1989 |
| EP | 0327519 | A1 | | 8/1989 |
| EP | 0 297 854 | A3 | | 5/1990 |
| EP | 1 457 429 | B1 | | 5/2008 |
| EP | 2420219 | A1 | | 2/2012 |
| FR | 2 893 922 | A1 | | 6/2007 |
| FR | 2967655 | B1 | | 3/2014 |
| JP | 61-24050 | U | | 2/1986 |
| JP | 2003-169840 | A | | 6/2003 |
| JP | 2004-283519 | A | | 10/2004 |
| JP | 2007-014513 | A | | 1/2007 |
| JP | 2009517297 | A | | 4/2009 |
| JP | 2010-075392 | A | | 4/2010 |
| WO | 2009/095488 | A1 | | 8/2009 |

* cited by examiner

OVERCAP INTENDED FOR A PHARMACEUTICAL CONTAINER

1) FIELD OF THE INVENTION

The present invention relates to an overcap intended for a pharmaceutical container, in particular a container for an infusion solution or an injection solution, having a receptacle containing at least one preproduced closure stopper accommodated therein, the stopper consisting of a soft plastic material, optionally after pulling off a protective covering, for insertion of a withdrawal cannula, a spike and/or a transfer set.

2) BACKGROUND

EP 1 457 429 B1 and prior art references disclosed herein refer to an overcap intended for a pharmaceutical container, in particular a container for an infusion solution or an injection solution, having a preproduced closure stopper accommodated therein, the stopper consisting of a soft plastic material, the closure stopper being weld-connected to the overcap and the overcap having an opening in its end face in which the closure stopper is exposed, optionally after pulling a protective covering, for insertion of a withdrawal cannula, which is characterized in that the welding is carried out in the end face of the overcap, surrounding in a closed manner the opening of the end face, the outer surface of the overcap being unaffected.

According to the overcap the stopper is inserted into the receptacle of the overcap from the bottom thereof. The stopper is fixed to the receptacle of the overcap by welding to the end face of the overcap. This welding furthermore ensures the prohibition of leakage so that the content of the container may leave in case of a non-perfect welding. An insertion of the stopper from the top side of the receptacle of the overcap is impossible according to EP 1 457 429 B1. Nothing avoids the packed solution to get in contact with the stopper materials.

DE 10 2004 034 899 A1 is directed to a concept of a sealing element for a bottle which is covered by an outer foil.

DE 20 2005 013 728 U1 relates to a stopper being inserted into the opening of the bottle and thus does not relate to an overcap.

CN 200951194 Y shows in FIGS. 2 and 5 an overcap for a container with two openings (stoppers). Each opening is covered by a respective stopper. The overcap contains an integral membrane within each opening and below the respective stopper. The stoppers are fixed to the overcap by laborious means and thus do not contain a top surface being exposed. Thus, in case a cannula, a spike and/or a transfer set is to be inserted for the use of parts or whole of the content of the container or for the introduction of new material like a medicament into the container such handling is quite complex.

Thus, the problem of the present invention is to overcome that laborious handling according to the prior art.

SUMMARY OF THE INVENTION

The present invention relates to an overcap intended for a pharmaceutical container, in particular a container for an infusion solution or an injection solution, having a receptacle containing at least one preproduced closure stopper accommodated therein, the stopper consisting of a soft plastic material, optionally after pulling off a protective covering, for insertion of a withdrawal cannula, a spike and/or a transfer set, whereby the complete top surface of said stopper is exposed whereby said stopper is press fitted and/or welded to said receptacle.

BRIEF DESCRIPTION OF THE DRAWINGS

The drawings are not meant to limit the scope of the invention beyond the claims. The drawings are to aid in the understanding of the invention.

DESCRIPTION OF THE PREFERRED EMBODIMENTS

Figure 1:
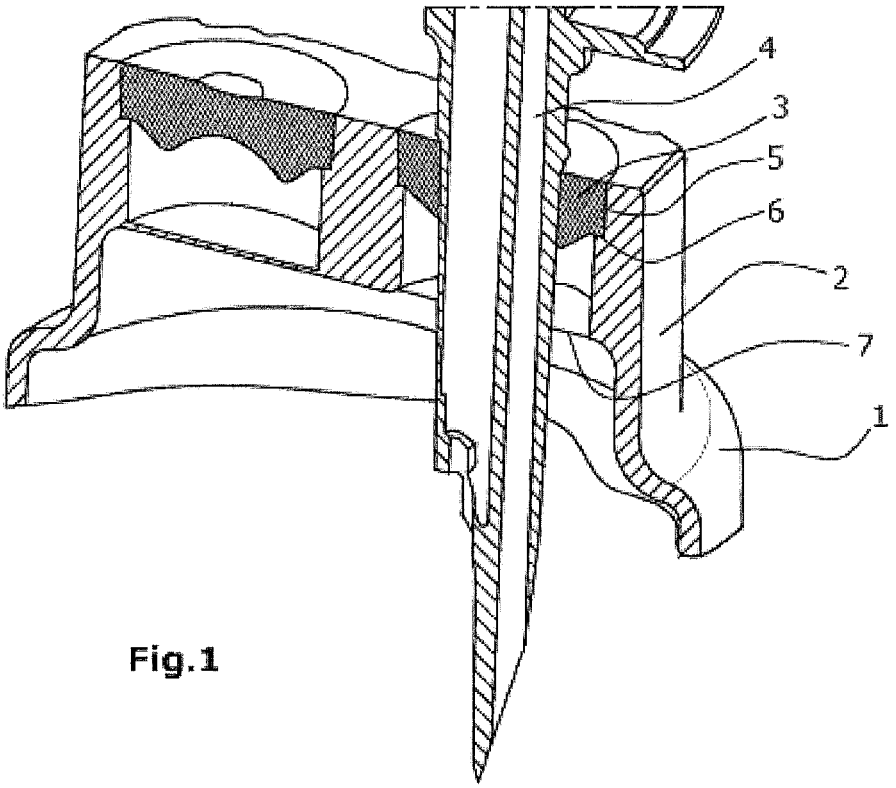
FIG. 1 is a cross-sectional perspective view of the overcap of the invention.

The problem mentioned above is solved by an overcap 1 intended for a pharmaceutical container, in particular a container for an infusion solution or an injection solution, having a receptacle 2 containing at least one preproduced closure stopper 3 accommodated therein, the stopper 3 consisting of a soft plastic material, optionally after pulling off a protective covering, for insertion of a withdrawal cannula, a spike 4 and/or a transfer set which is characterized by the complete top surface of said stopper 3 being exposed whereby said stopper is press fitted and/or weld connected to said receptacle 2.

The overcap 1 according to the present invention may be manufactured by the introduction of the stopper 3 from the top-side of the receptacle 2. Said manufacturing is much easier than introducing the stopper 3 from the lower side where the overcap 1 is to be connected to the container. In particular, said manufacturing allows the presence of a septum which is synonym in the sense of the present invention to a membrane 7 below the stopper 3 in order to protect the solution in the container from contact with the stopper 3. Press fitting, in particular squeezing the stopper 3 into the receptacle 2 preferably from the top end portion of the receptacle 2 allows a leak tight connection even in case that a cannula, a spike 4 and/or a transfer set is introduced into the stopper 3 for introducing medicaments and/or an injection solution or for using the content of the container to be administered to a patient.

The complete top surface of the stopper 3 is visible and thus allows an easy puncture thereof as is shown in FIG. 1.

Preferably, the overcap 1 contains more than one stopper 3, in particular two stoppers 3 and an appropriate number of openings to accommodate an appropriate number of stoppers 3. The material of the stopper 3 is made of a soft plastic and thus, in particular a thermoplastic elastomer may be used. An appropriate description of such stoppers 3 may be found in EP 1 457 429 B1 [0009]. In addition thereto, other materials may be used such as rubber or silicone.

FIG. 1 shows an appropriate overcap 1 having a two-fold cylindrical extension above the level of the rim of the overcap 1 including a receptacle 2 wherein the stopper 3 is inserted from the top level of the receptacle 2. As an alternative however, the top surface of the stopper 3 may be inserted within the receptacle 2 at a lower level. The spike 4 is not part of the invention.

FIG. 1 furthermore shows that the stopper 3 resides on a neck 6. Said neck 6 has the benefit of prohibiting sinking of the stopper in case that too much force is used for the introduction of the cannula, spike and/or transfer set. FIG. 1 furthermore illustrates potential welding surfaces to connect the stopper 3 to the receptacle 2. FIG. 1 shows the vertical cylindrical surface of the receptacle and the horizontal neck 6 in the form of an annula which may serve as support for the stopper 3.

The inner wall 5 of said receptacle 2 preferably may have a cylindrical, elliptical or polygonal horizontal cross section accommodating an appropriate stopper 3 therein.

In a further preferred embodiment the vertical cross section of said inner wall 5 may have a conical structure with truncated cone preferably having the diminution of the radius in the direction of the container accommodating an appropriate stopper 3 therein. Said stopper 3 may be in this case of cylindrical or conical form and thus not necessarily having a complete contact to the inner wall 5 of the receptacle 2.

In a further embodiment the overcap 1 according to the present invention may be characterized in that said inner wall 5 of said receptacle 2 has a multi-cylindrical cross section with at least two different radii, coaxially connected by an appropriate number of necks 6 accommodating an appropriate cylindrical stopper 3 therein.

Figure 2:
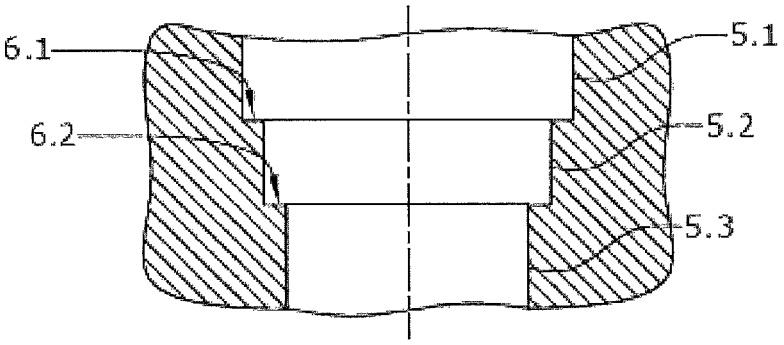
FIG. 2 is a cross-sectional view of a preferred embodiment of the inner wall and neck of the overcap.

FIG. 2 depicts an appropriate multi-cylindrical cross section with two different necks 6.1 and 6.2. It goes without saying that the diminution of the radii of said multi-cylindrical cross section in the same way may be in the different direction so that the smallest radii is to be found at the top surface of the receptacle of the overcap 1. The stopper 3 introduced into said receptacle 2 may have the same multi-cylindrical cross section but as an alternative may have only one cylindrical cross section that enters in contact with the inner side wall 5 of the receptacle 2 only and thus not being in complete contact with the inner wall 5 of the receptacle 2.

In order to avoid leakage welding of the stopper 3 to the inner wall of the receptacle 2 or tight press fitting is a preferred embodiment of the present invention as mentioned above. In a highly preferred embodiment said welding is achieved by welding of the entire connecting surface between said inner wall 5 and said stopper 3. Thus, the inner walls 5.1, 5.2 and or 5.3 as shown in FIG. 2 may be weld connected to the stoppers 3. In addition thereto and/or instead thereof welding may be achieved by the annular ring being part of the necks 6.1 and/or 6.2.

A further alternative of the present invention is to be seen in that not the entire connecting surface between inner wall 5 and said stopper 3 is welded, in particular is effected by at least one weld lines so that there is no way to escape from container side to external side without crossing any weld line. Such weld line may be positioned along the inner walls 5 and/or the necks 6 only. The stopper (3) may be weld connected to at least one cylindrical circumferential part of the inner wall (5) and the at least one neck (6).

A further preferred embodiment is characterized in that said at least one line is effected in at least one closed horizontal line, zigzag, meander, stacked closed horizontal lines, grid patterns and combinations thereof.

Figure 3:
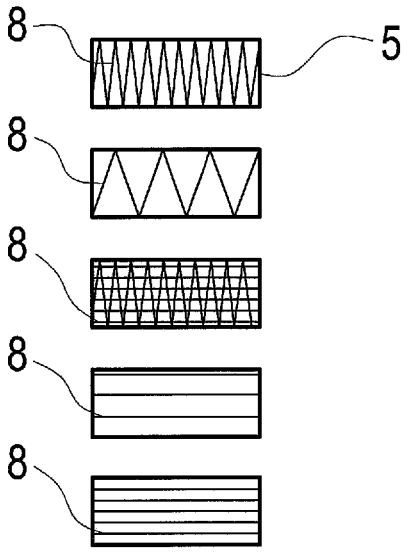
FIG. 3 shows different variations of weld lines to provide a leak-tight connection of the stopper to the inner wall.

FIG. 3 demonstrates on the basis of a cylindrical inner wall 5 different variations of such weld lines. All weld lines or grid patterns have in common in that lines are closed and thus provide a leak-tight connection of the stopper 3 to the inner wall 5.

In a further preferred embodiment welding of the stopper 3 to the inner wall 5 may be effected by at least one or more open lines, dots and combinations thereof in such a way that it is possible to find a path from container side to external side without crossing any weld lines.

Figure 4:
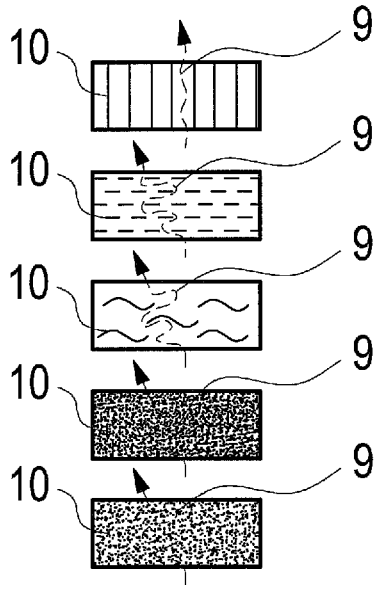
FIG. 4 shows various combinations of non-leak-tight connections of the stopper to the inner wall.

FIG. 4 shows various combinations of such non-leak-tight connections of the stopper 3 to the inner wall 5 of the receptacle 2. Preferably, said at least one open line or dots may be effected in at least one horizontal line, zigzag, meander, spiral, stacked open horizontal lines, vertical non-contiguous lines, random dots, patterned dots and grid pattern or combinations thereof.

According to the present invention said welding as mentioned above is preferably achieved by laser welding as is disclosed in the prior art as mentioned above.

In a further preferred embodiment of the present invention, the overcap 1 according to the present invention contains at least one membrane 7 prohibiting the content of said container getting into contact with said stopper 3. As soon as the membrane is pierced, contact may occur, as fluid may find a way to fill the volume between membrane and stopper. However, the important point is that during shelf life, the membrane 7 will strongly limit or even avoid migration of components of the stoppers 3 into the solution. FIG. 1 shows an appropriate embodiment with two membranes 7 prohibiting the flow of the content of the container to the top part of the overcap 1 and thus prohibiting the content of the container getting in long term contact with the material of the stopper 3. Thus, even in case a cannula, a spike 4 and/or a transfer set is introduced into the overcap 1 by puncturing the stopper 2 and the membrane(s) 7, such contact of the content of the container with the material of the stopper 3 and even that of the welded parts is may be avoided. While FIG. 1 shows two separate membranes 7, a further preferred embodiment in the present invention is to be seen in that one common membrane 7 is provided within the receptacle 2 of the overcap 1.

Said membrane 7 according to the present invention may be an integral part of the overcap 1 or the receptacle 2. An alternative thereto is a film leak-tight welded to the overcap 1 or the receptacle 2

Accordingly, the locating of the membrane 7 may be selected due to the need and thus, in particular, a location of the membrane 7 within the area of the receptacle 2 is preferred. This of course also relates to a multitude of membranes 7.

Preferably, the shape of the membrane 7 may be selected due to the specific needs. The membrane 7 may have a flat form, a dome shaped form or a ripple form in particular in view of a potential pressure balance after the filing of the container and its combination with the overcap 1 according to the present invention or during the insertion of the stopper 3 in the receptacle 2, the capping of the container and/or the sterilisation of the closed container system In the same way, the pressure balance when introducing the cannula, spike 4 and/or transfer set may determine the shape of the membrane 7. The connection of the overcap 1 according to the present invention may be performed in the same way as in the prior art as mentioned above.

Accordingly, the overcap 1 and the membrane 7 may be mold-injected in one shot, and thus providing a membrane being an integral part of the overcap 1.

In addition thereto, after mold-injecting an overcap 1 without a membrane 7, said membrane 7 in the form of a foil or a film may be welded to the overcap 1 at a separate step.

The invention claimed is:

1. An overcap (1) intended for a pharmaceutical container for an infusion solution or an injection solution, having a receptacle (2) containing at least one preproduced closure stopper (3), the stopper (3) being introduced from the topside of the receptacle, consisting of a plastic material, for, optionally after pulling off a protective covering, insertion of a withdrawal cannula (4), a spike and/or transfer set, wherein the complete top surface of said stopper (3) is exposed, whereby said stopper (3) is press fitted and weld connected to an inner wall (5) of said receptacle (2), said inner wall (5) has a multi-cylindrical cross-section with at least two different radii, coaxially connected by at least one neck (6) accommodating the stopper (3).

2. The overcap (1) according to claim 1, characterized in that said stopper (3) is weld connected to at least one cylindrical circumferential part of the inner wall (5).

3. The overcap (1) according to claim 1, characterized in that said stopper (3) is weld connected to at least one cylindrical circumferential part of the inner wall (5) and the at least one neck (6).

4. The overcap (1) according to claim 3 characterized in that said weld is achieved by welding of an entire connecting surface between said inner wall (5) and said stopper (3).

5. The overcap (1) according to claim 1 characterized in that said weld is effected so there is no way for the solution to escape from container side to external side.

6. The overcap (1) according to claim 1 characterized in that at least one line is effected in at least one closed horizontal line, zigzag, meander, stacked closed horizontal lines, grid patterns and combinations thereof.

7. The overcap (1) according to claim 3 characterized in that said weld is at least one open line, dots, and combinations thereof.

8. The overcap (1) according to claim 7, characterized in that at least one open weld line or dots is effected in at least one open horizontal zigzag, meander, spiral, stacked open horizontal lines, vertical noncontiguous lines, random dots, patterned dots and grid patterns or combinations thereof.

9. The overcap (1) according to claim 3 characterized in that said weld is achieved by laser welding.

10. The overcap according to claim 1, characterized in it contains at least one membrane (7) that prohibits the contents of the container from contacting said stopper (3).

11. The overcap (1) according to claim 10, characterized in that said membrane (7) is an integral part of the receptacle (2) or a film welded to the receptacle (2) or a lower part of the overcap (1).

12. The overcap (1) according to claim 10, characterized in that said membrane (7) is located within an area of the receptacle (2).

13. The overcap (1) according to claim 10, characterized in that the membrane (7) has a flat form, a dome shaped form or a ripple form.

* * * * *